US007713035B2

(12) United States Patent
Ford

(10) Patent No.: US 7,713,035 B2
(45) Date of Patent: May 11, 2010

(54) CYCLONIC DEBRIS REMOVAL DEVICE AND METHOD FOR A PUMPING APPARATUS

(76) Inventor: Michael Brant Ford, 2716 Rio Vista, St. George, UT (US) 84790

( * ) Notice: Subject to any disclaimer, the term of this patent is extended or adjusted under 35 U.S.C. 154(b) by 987 days.

(21) Appl. No.: 10/966,783

(22) Filed: Oct. 15, 2004

(65) Prior Publication Data

US 2006/0083646 A1 Apr. 20, 2006

(51) Int. Cl.
*F04B 39/00* (2006.01)
*F04B 53/00* (2006.01)

(52) U.S. Cl. ..... 417/430; 417/555.1

(58) Field of Classification Search ..... 417/554, 417/555.1, 430, 445, 423.9, 555.2; 166/369, 166/265, 105.2; 209/725; 210/512.2, 170.07, 210/511, 512.3; 92/112
See application file for complete search history.

(56) References Cited

U.S. PATENT DOCUMENTS 2,074,591 A * 3/1937 Rood ..... 417/554
2,231,861 A * 2/1941 Adams ..... 417/459
2,635,554 A * 4/1953 Haley ..... 417/554
2,862,457 A * 12/1958 Williams ..... 166/105.2
3,235,091 A * 2/1966 Doll et al. ..... 210/512.1
4,148,735 A * 4/1979 Laval, Jr. ..... 210/512.1
4,241,787 A * 12/1980 Price ..... 166/105
4,395,204 A * 7/1983 Turner ..... 417/554
4,494,607 A * 1/1985 Ford et al. ..... 166/311
4,621,987 A * 11/1986 Spingath, Jr. ..... 417/313
4,913,630 A * 4/1990 Cotherman et al. ..... 417/313
4,969,518 A * 11/1990 Schmitt et al. ..... 166/228
4,983,105 A * 1/1991 Mims, Sr. ..... 417/554
5,196,108 A * 3/1993 Wilmeth et al. ..... 205/243
5,314,018 A * 5/1994 Cobb ..... 166/265
5,593,289 A * 1/1997 Tarpley ..... 417/454
RE35,454 E * 2/1997 Cobb ..... 166/265
5,660,534 A * 8/1997 Snow ..... 417/554
5,752,814 A * 5/1998 Starks et al. ..... 417/554
6,080,312 A * 6/2000 Bowers et al. ..... 210/512.2
6,089,317 A * 7/2000 Shaw ..... 166/265
6,099,274 A * 8/2000 Conn ..... 417/547

(Continued)

*Primary Examiner*—Charles G Freay
*Assistant Examiner*—Alexander B Comley
(74) *Attorney, Agent, or Firm*—Jeffrey Weiss; Weiss & Moy, P.C.

(57) ABSTRACT

A pumping apparatus and method incorporates at least one and preferably as many as four components that are configured to improve debris removal capabilities as compared to prior art apparatuses. The apparatus and method impart cyclonic motion to pumped fluid, in a manner that tends to separate entrained solids and other impurities, and further that helps draw solid impurities away from the pump barrel. In a preferred embodiment, a cyclonic effect first occurs in a seat plug having a funnel-shaped accumulator region leading to an interior passage therethrough, and at least one off-center opening extending from the interior passage to the exterior of the plug. In one embodiment, that effect is continued at a plunger adapter that has a plurality of inward-angled rings, and that also features off-center openings through which debris may pass to the interior of the plunger adapter. A top plunger adapter may also be provided, having angled veins and openings therethrough to impart cyclonic motion to the pumped fluid as it exits the interior of the top plunger adapter. Finally, it may also be desired to provide a cage having angled veins, to continue the cyclonic effect on the fluid as it travels northward and into the pump barrel.

15 Claims, 5 Drawing Sheets

U.S. PATENT DOCUMENTS 6,135,203 A * 10/2000 McAnally ..... 166/105.2
6,145,590 A * 11/2000 Havard ..... 166/105.2
6,182,754 B1 * 2/2001 Vermeeren ..... 166/176
6,269,880 B1 * 8/2001 Landry ..... 166/265
6,280,502 B1 * 8/2001 van Veen et al. ..... 95/29
6,290,475 B1 * 9/2001 Snow ..... 417/430
6,371,206 B1 * 4/2002 Mills ..... 166/311
6,394,183 B1 * 5/2002 Schrenkel et al. ..... 166/265
6,426,010 B1 * 7/2002 Lecoffre et al. ..... 210/781
6,439,311 B2 * 8/2002 Haseloh ..... 166/311
6,481,987 B2 * 11/2002 Ford ..... 417/554
6,666,338 B1 * 12/2003 Henriksson et al. ..... 209/725
6,698,521 B2 * 3/2004 Schrenkel et al. ..... 166/369
6,767,461 B1 * 7/2004 Caulfield ..... 210/512.3
2002/0194988 A1 * 12/2002 Betting et al. ..... 95/29

* cited by examiner

CYCLONIC DEBRIS REMOVAL DEVICE AND METHOD FOR A PUMPING APPARATUS

BACKGROUND OF THE INVENTION

1. Field of Invention

This invention relates generally to fluid pumping apparatuses and, more specifically, to an improved debris removal device and method.

2. Background of the Invention

In general terms, a fluid pumping system begins with an above-ground pumping unit, which creates the up and down pumping action that moves the fluid (or other substance being pumped) out of the ground and into a flow line, from which the fluid is taken to a storage tank or other such structure.

Below ground, a shaft is lined with piping known as "tubing." Into the tubing is inserted a sucker rod, which is ultimately, indirectly, coupled at its north end to the pumping unit. The sucker rod is coupled at its south end, indirectly, to the fluid pump itself, which is also located within the tubing and which is sealed at its base to the tubing. The sucker rod will typically couple to the fluid pump at a coupling known as cage.

Beginning at the south end, fluid pumps generally include a standing valve, which has a ball therein, the purpose of which is to regulate the passage of fluid (or other substance being pumped) from downhole into the pump, allowing the pumped matter to be moved northward out of the system and into the flow line, while preventing the pumped matter from dropping back southward into the hole. Fluid is permitted to pass through the standing valve and into the pump by the movement of the ball off of its seat, and fluid is prevented from dropping back into the hole by the seating of the ball.

North of the standing valve, coupled to the sucker rod, is a pump plunger with a traveling valve attached thereto. The purpose of the plunger/traveling valve is to regulate the passage of fluid from within the pump northward in the direction of the flow line, while preventing the pumped fluid from dropping back in the direction of the standing valve and hole.

Actual movement of the pumped substance through the system will now be discussed. Fluid is pumped from a hole through a series of "downstrokes" and "upstrokes" of the fluid pump, which motion is imparted by the above-ground pumping unit. During the upstroke, formation pressure causes the ball in the standing valve to move upward, allowing the fluid to pass through the standing valve and into the barrel of the fluid pump. This fluid will be held in place between the standing valve and the traveling valve. In the traveling valve, the ball is located in the seated position. It is held there by the pressure from the fluid that has been previously pumped. The fluid located above the traveling valve is moved northward in the direction of the cage at the end of the fluid pump.

On the downstroke, the ball in the traveling valve unseats, permitting the fluid that has passed through the standing valve to pass therethrough. Also during the downstroke, the ball in the standing valve seats, preventing the pumped fluid from moving back down into the hole.

The process repeats itself again and again, with fluid essentially being moved in stages from the hole, to above the standing valve and in the fluid pump, to above the traveling valve and out of the fluid pump. As the fluid pump fills, the fluid passes through the cage and into the tubing. As the tubing is filled, the fluid passes into the flow line, from which the fluid is taken to a storage tank or other such structure.

There are a number of problems that are regularly encountered during fluid pumping operations. Fluid that is pumped from the ground is generally impure, and includes solid impurities such as sand, as well as water and gas. Solid impurities may be harmful to a pumping apparatus and its components for a number of reasons. For example, sand can become trapped between the barrel and the plunger, between which there is only an extremely narrow tolerance. This can create scarring and damage to the plunger or barrel and in some instances can even cause the pump to become stuck, requiring the extraction of pump components for repair. Solid impurities can also enter between the ball and seat of the traveling valve in particular, preventing proper seating, possibly leading to damage and inefficiency.

An additional problem with prior art pumping apparatuses is that emulsification of impurities can occur, requiring post-pumping treatment to separate the pumped fluid and the various impurities entrained therein.

The present invention addresses these problems encountered in prior art pumping systems and provides other, related, advantages.

DETAILED DESCRIPTION OF THE PREFERRED EMBODIMENTS

Figure 8:
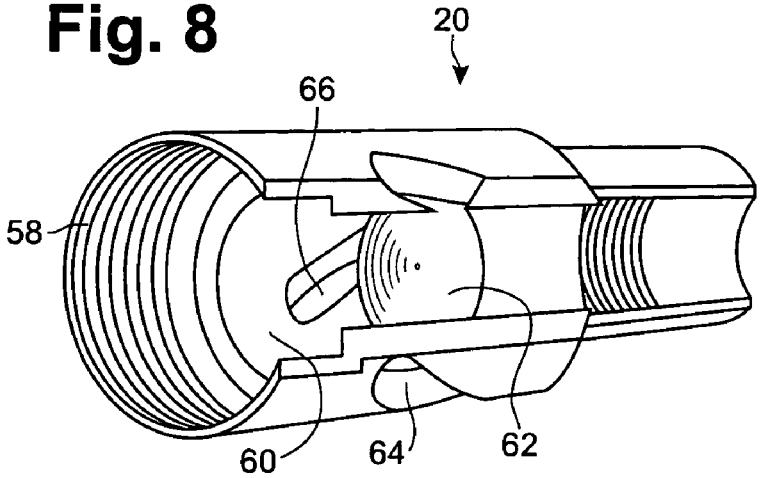
FIG. 8 is a perspective, cross-sectional view of the cyclone top plunger adapter of FIG. 3.
Figure 9:
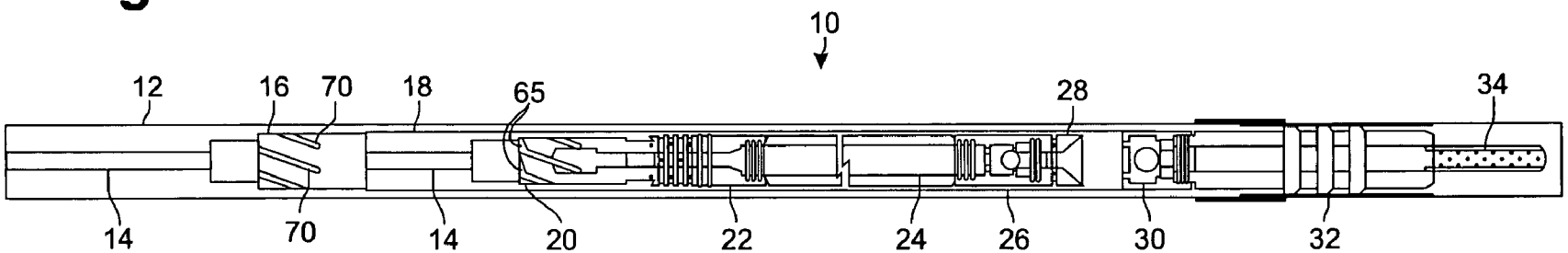
FIG. 9 is a side view of a pumping apparatus having an embodiment of a cyclone debris removal apparatus of the present invention inserted therein.

Referring first to FIG. 9, a pumping apparatus 10, having a cyclone debris removal apparatus consistent with the present invention inserted therein, is illustrated. Moving left to right within the drawing figure, corresponding to movement from north to south within a typical pumping system, the components of the pumping apparatus 10 will be described. The shaft is lined with tubing 12. A valve rod/hollow valve rod 14 passes through or is attached to a valve rod guide/cyclone open cage 16, and is coupled at its south end to a cyclone top plunger adapter 20 (shown in more detail in FIGS. 3, 5 and 8). (North of the valve rod/hollow valve rod 14, a cage (not shown) couples between the sucker rod (not shown) and the valve rod/hollow valve rod 14.) A cyclone plunger adapter 22 (shown in more detail in FIGS. 2, 5 and 7) is then interposed between the cyclone top plunger adapter 20 and a pump plunger 24. A traveling valve 26 is located south of the pump plunger 24, and a seat plug component 28 (shown in more detail in FIGS. 1 and 6) is coupled below the traveling valve 26.

It should be noted that above-listed components, beginning with the portion of the valve rod/hollow valve rod 14 located below the open cage 16 and extending to the seat plug component 28, are located within a pump barrel 18.

Continuing with FIG. 9, a standing valve 30 is located at the south end of the pump barrel 18, below the seat plug component 28. Below the standing valve 30, from north to south, are a seating nipple 32 and gas anchor 34.

Figure 1:
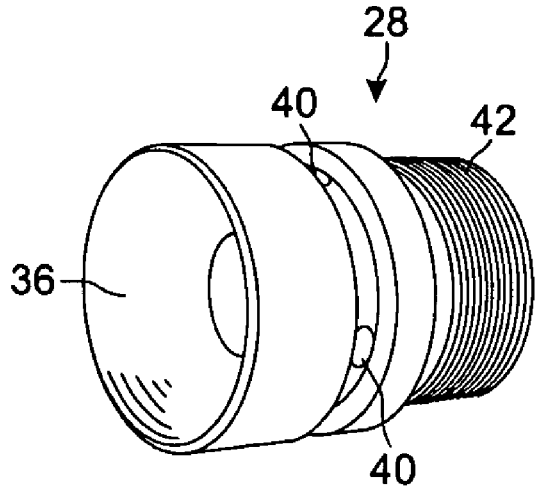
FIG. 1 is a perspective view of an embodiment of a seat plug component of a cyclonic debris removal apparatus consistent with an embodiment of the present invention.
Figure 6:
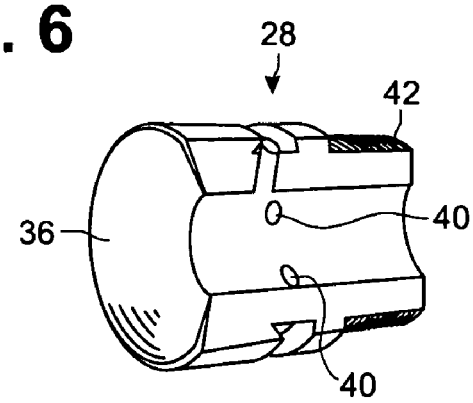
FIG. 6 is a perspective, cross-sectional view of seat plug component of FIG. 1.

Referring now to FIGS. 1 and 6, additional description is provided for the seat plug component 28. Preferably, as illustrated in FIG. 9, this component is coupled to the south end of the traveling valve 26, and more specifically to the cage portion of the traveling valve 26. The seat plug component 28 preferably has a funnel-shaped evacuation accumulator region 36 at a south end thereof. This configuration moves fluid, as it is pumped northward, from a region of greater diameter to a region of lesser diameter, accelerating its rate of travel. Above the accumulator region 36 is located an inwardly-angled groove 38, into which at least one and preferably a plurality of openings 40 are provided. Four openings 40 are preferred. It is preferred that the openings 40 be angled, so that they open in an off-centered manner to the interior of the seat plug component 28.

Threaded region 42 is adapted to be coupled to the south end of the traveling valve 26. While threaded region 42 is shown as male, it should be recognized that if the south end of the traveling valve 26 is male, than threaded region 42 should be female.

Figure 2:
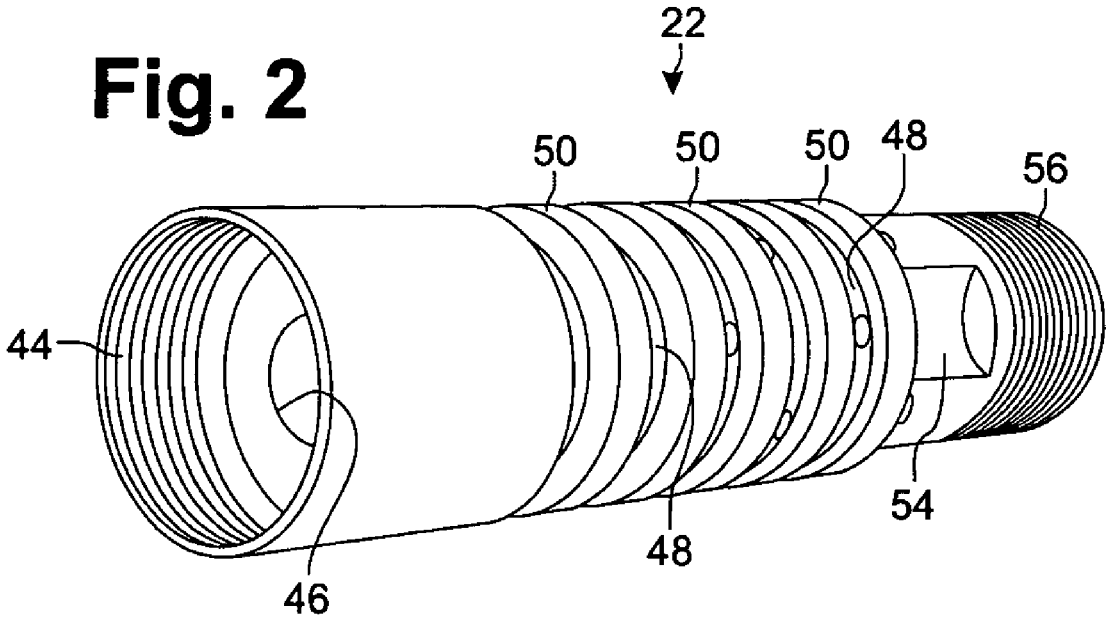
FIG. 2 is a perspective view of an embodiment of a cyclone plunger component of a cyclonic debris removal apparatus consistent with an embodiment of the present invention.
Figure 5:
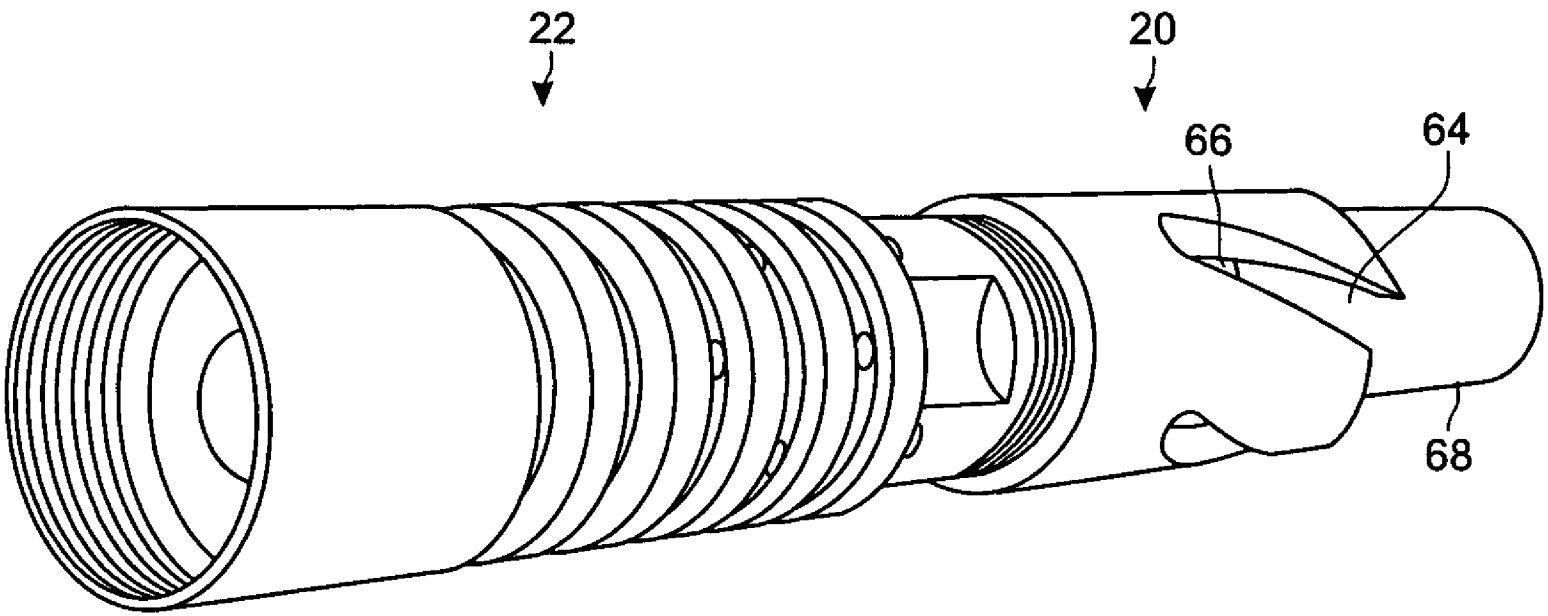
FIG. 5 is a perspective view illustrating coupling of the cyclone plunger of FIG. 2 to the cyclone top plunger adapter of FIG. 3.
Figure 7:
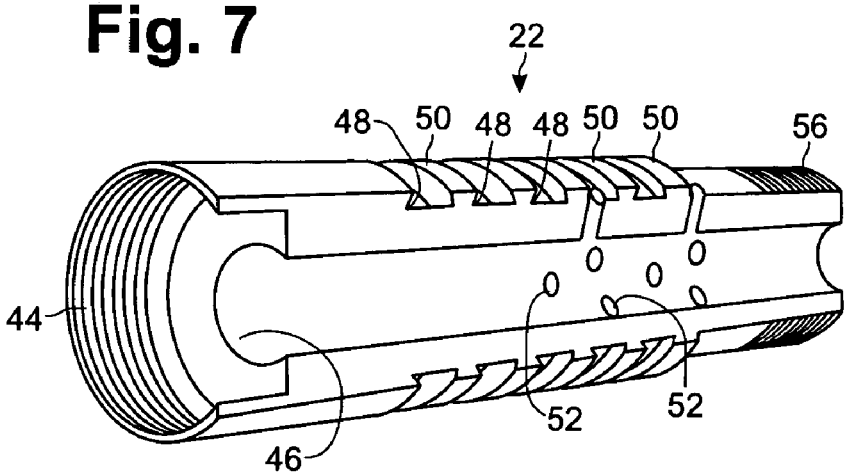
FIG. 7 is a perspective, cross-sectional view of the cyclone plunger of FIG. 2.

Referring now to FIGS. 2, 5 and 7, the cyclone plunger adapter 22 is described in greater detail. Beginning at its south end, a threaded region 44 is provided, to facilitate coupling to a corresponding threaded region on a pump plunger 24. It can be seen that within the interior of the cyclone plunger adapter 22 and north of the threaded region 44 is provided a region of reduced inner diameter 46. (It may be desired to provide a funnel-shaped transition area to the region 46, similar to the accumulator region 36.)

Turning now to the exterior of the cyclone plunger adapter 22, at least one and preferably a plurality of grooves 48 are provided, with rings 50 interposed between the grooves 48. The number of grooves 48 and rings 50 can be varied as desired. As shown in FIGS. 2 and 5, five grooves 48 and five rings 50 are preferred.

It is preferred that the outer diameter of the rings 50 progressively decrease from south to north, so that each succeeding ring 50 has a smaller outer diameter than the one below it. The amount of decrease can be varied as desired, with a decrease in the range of about ten-thousandths of an inch being preferred. As best shown in FIG. 7—, it is preferred that the rings 50 be angled inward, to facilitate the entry of solid impurities into grooves 48.

As shown in FIGS. 2 and 7, it is preferred that at least one and preferably a plurality of openings 52 are provided in at least one, and preferably a plurality, of the grooves 48. It is preferred that the openings 52 be angled, so that they open in an off-centered manner to the interior of the cyclone plunger adapter 22.

North of the grooves 48 and rings 50 are preferably located a pair of opposing wrench flats 54. The wrench flats 54 are intended to facilitate coupling and de-coupling of the cyclone plunger adapter to other pump components.

At the north end of the cyclone plunger adapter 22 is a threaded region 56. The threaded region 56, in the embodiment shown in FIG. 9, couples to a mating threaded area in the cyclone top plunger adapter 20.

Figure 3:
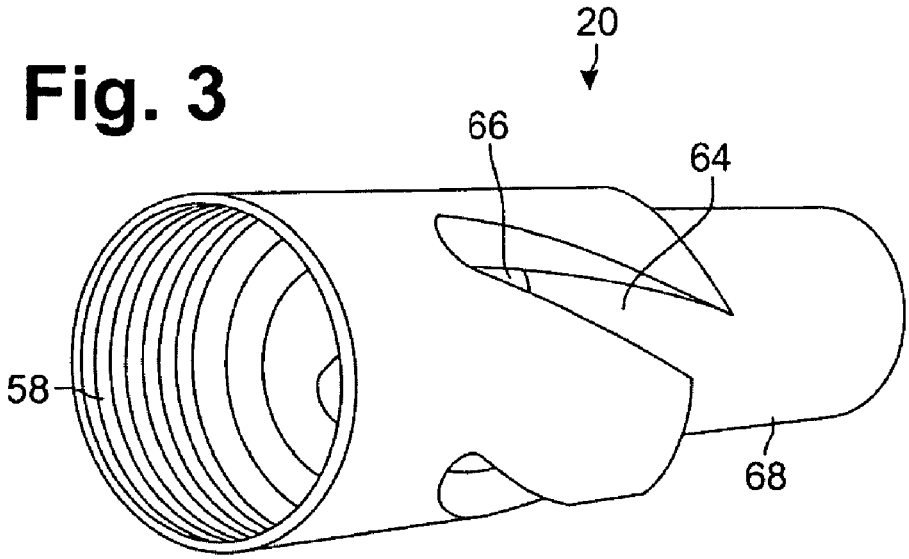
FIG. 3 is a perspective view of an embodiment of a cyclone top plunger adapter component of a cyclonic debris removal apparatus consistent with an embodiment of the present invention.

Referring now to FIGS. 3 and 5, attention is directed to the cyclone top plunger adapter 20. Turning first to an examination of the interior of the cyclone top plunger adapter 20, it can be seen that there is provided a threaded region 58, which is adapted to mate with threaded region 56 on the cyclone plunger adapter 22. Continuing above the threaded region 56, it can be seen that there is a passage 60, through which pumped fluid travels northward. Passage 60 terminates at cap 62.

Turning to the exterior of the cyclone top plunger adapter 20, a plurality of veins 64 are provided. While the number of veins 64 may be varied, four veins 64 are preferred. Where the pumping apparatus 10 is used in the northern hemisphere, the veins 64 should be cut, from south to north, in a west to east direction. For use in the southern hemisphere, the channels should be cut in an east to west direction.

Elongated openings 66 are preferably provided in a lower portion of veins 64, to permit the passage of pumped fluid from passage 60 out of the interior of the cyclone top plunger adapter 20 and into the upper portion of veins 64. As best shown in FIG. 8, it can be seen that cap 62 is preferably positioned so that the passage 60 terminates proximate the north terminus of openings 66, so as to more effectively direct pumped fluid from the passage 60, through openings 66 and into the upper portion of veins 64.

Referring to FIGS. 3, 5 and 8, and continuing to refer to the exterior of the cyclone top plunger adapter 20, it can be seen that it is preferred to provide a region 68 of lesser external diameter north of the veins 64. Alternatively, veins 64 could be permitted to continue to substantially the north terminus of the cyclone top plunger adapter 20.

As best seen in FIG. 9, it is preferred that a notched area 65 be provided along one side of each of the veins 64. This configuration further promotes the passage of settling solids into the veins 64, with settling solids either passing directly into a vein 64, or first into a notched area 65 and then into a vein 64.

Referring again to FIG. 9, the valve rod guide/cyclone open cage 16 preferably has a plurality of angled veins 70. The veins 70 should be cut in the same direction as the veins 64. The veins 70 serve to continue the spiraling effect on the fluid as it proceeds northward, enhancing the separation effect.

Statement of Operation

As with a prior art system, fluid will be pumped from a hole through a series of "downstrokes" and "upstrokes" of a pump, which motion is imparted by the above-ground pumping unit. During the upstroke, formation pressure causes the ball in the standing valve 30 to move upward, allowing the fluid to pass through the standing valve and into the barrel 18. This fluid will be held in place between the standing valve 30 and the traveling valve 26. In the traveling valve 26, the ball is located in the seated position.

On the downstroke, the ball is lifted off of the seat, permitting the fluid that has passed through the standing valve 30 to pass through the seat plug component 28 and into the traveling valve 26. In this regard, fluid entering the interior of the seat plug component 28 will enter the funnel-shaped evacuation accumulator region 36 at a south end thereof. Thus, fluid is moved from a region of greater diameter to a region of lesser diameter, accelerating its rate of travel.

It should be noted that while most fluid pumped northward will travel through the interior of the seat plug component 28, some fluid will also pass to the exterior thereof, between the exterior of the seat plug component 28 and the pump barrel 18. The funneling of the region 36 increases the velocity of the pumped fluid as it travels northward, as compared to fluid traveling on the exterior of the seat plug component 28. This creates a vacuum effect, drawing in fluid, and in particular solid impurities within the fluid, through openings 40 from the exterior of the seat plug component 28 to the interior thereof. The off-center configuration of the openings 40 contributes to a cyclonic effect that occurs as fluid is drawn into the interior of the seat plug component 28.

Figure 4:
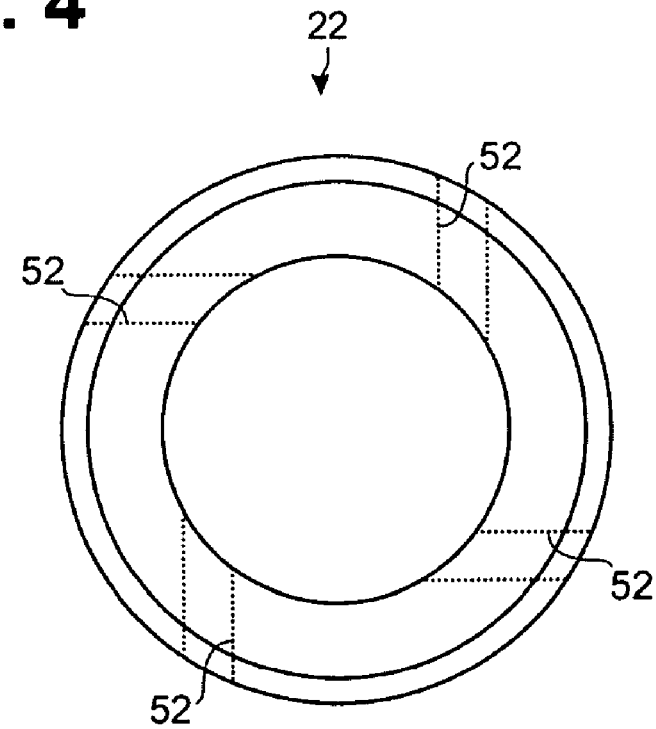
FIG. 4 is an end, cross-sectional view of the cyclone plunger of FIG. 2.

Moving to the cyclone plunger adapter 22, the fluid again passes into an area of reduced diameter when it enters the region 46. As described above with respect to the seat plug component 28, the reduction of diameter increases the velocity of the pumped fluid and creates a vacuum effect. This draws in fluid, and in particular debris within the fluid, from the exterior of the cyclone plunger adapter 22—this time through openings 52 within rings 48. The inward angle of the rings 50 facilitates the entry of solid impurities into grooves 48. The off-center configuration of the openings 52, as shown in FIG 4. contributes to a cyclonic effect that occurs as fluid is drawn into the interior of the cyclone plunger adapter 22. Still further, the decrease in the outer diameter of rings 50 increases the flow of fluid into the interior of the cyclone plunger adapter 22 through openings 52.

It should be noted that the greatest probability of pump sticking and/or apparatus damage occurs on the upstroke. This is explained by the fact that on the downstroke, the seat plug component 28 diverts the majority of the pumped fluid inward, creating the herein described cyclonic effect, which draws in fluid and solid impurities. On the upstroke, the hydrostatic column of fluid above the traveling valve will seek area of least resistance, which is between the barrel and the plunger. This fluid is contaminated with solid impurities, and these impurities will tend to accumulate at the rings 50 as they settle.

By narrowing the outer diameter of the rings 50 as they move northward, a wedge effect is created. As the plunger is pulled upward on the upstroke, fluid between the barrel and the plunger is forced into the openings 48 at progressively greater pressure, as the diameter of the rings 50 progressively increases. This tends to prevent solid impurities from accumulating between the cyclone plunger adapter 22 and the barrel 18.

As the fluid passes northward into the cyclone top plunger adapter 20, it will enter passage 60, and continue until reaching cap 62. With its passage blocked by cap 62, pumped fluid will exit via elongated openings 66, and enter veins 64. Angling of veins 64 imparts rotation to the cyclone top plunger adapter 20, as well as to the other components (including the cyclone plunger adapter 22 and seat plug component 28), that are directly or indirectly coupled thereto. The rotation of these pump components further contributes to the drawing into the interior of pump components of debris located between pump components and the barrel 18. Moreover, it creates a centrifuge effect on the interior of the pump components, preventing emulsification of fluid, liquid impurities (e.g., water) and solid impurities (e.g., sand). By resisting emulsification, the pumping apparatus 10 of the present invention, as herein configured, can reduce the need for treatment of pumped fluids for purposes of breaking the emulsification of pumped fluids and impurities entrained therein.

The veins 64, including the upper angled portions thereof, provide at least one additional benefit. When the pumping apparatus 10 is shut down, the entrained solids located thereabove tend to settle. In prior art systems, these can become lodged between the exterior of individual pump components and the barrel 18, causing damage and potentially even sticking of the apparatus. Here, settling solids should either pass directly into a vein 64, or first into a notched area 65 and then into a vein 64.

The northward traveling fluid will next enter the valve rod guide/cyclone open cage 16. It will exit through openings (not shown) in the angled veins 70, which continue the spiraling effect on the fluid as it proceeds northward, enhancing the separation effect.

The term "fluid" as used herein is intended to refer to any material capable of being pumped using an pumping apparatus 10 as herein described, including for example oil and water.

While the invention has been particularly shown and described with reference to preferred embodiments thereof, it will be understood by those skilled in the art that the foregoing and other changes in form and details may be made therein without departing from the spirit and scope of the invention.

For example, and in addition to the variations discussed above, it would be possible to combine certain of the separate component portions of the pumping apparatus 10 into one-piece assemblies, so as to reduce the number of individual components parts. Thus, the cyclone plunger adapter 22 and cyclone top plunger 20 could be a one-piece assembly, or could be formed of more than two component portions. It may be desired to provide only one of the seat plug component 28, the cyclone plunger adapter 22, cyclone top plunger 20, valve rod guide/cyclone open cage 16—or any combination of two or three of these—without providing all four of these combined.

I claim:

1. A pumping apparatus comprising, in combination:

a seat plug;

a traveling valve coupled at its south end to said seat plug;

a pump plunger coupled at its south end to said traveling valve;

a plunger adapter having a north end and a south end coupled at its south end to said pump plunger;

wherein said plunger adapter comprises, in combination:

an interior passage;

at least one ring on an exterior portion thereof;

at least one circumferential groove on an exterior portion thereof;

at least one opening in said circumferential groove and continuing through to said interior passage;

wherein said at least one opening is angled so that it opens in an off-centered manner to said interior passage, wherein a size of said angle is sufficient to enable said at least one opening to impart a cyclonic effect on fluid entering therethrough; and a valve rod coupled at its south end to said plunger adapter.

2. The pumping apparatus of claim 1 wherein said at least one ring is inwardly angled.

3. The pumping apparatus of claim 1 further comprising a plurality of rings and a plurality of circumferential grooves located on an exterior portion of said plunger adapter, wherein said plurality of circumferential grooves are interspersed between said plurality of rings, and wherein an outer diameter of said plurality of rings progressively decreases from south to north so that each succeeding one of said plurality of rings has a smaller outer diameter than the one below it.

4. The pumping apparatus of claim 3 comprising five said grooves and five said rings.

5. The pumping apparatus of claim 1 wherein said seat plug has an interior passage therethrough, which is entered through a funnel-shaped evacuation accumulator region.

6. The pumping apparatus of claim 5, further comprising at least one inwardly-angled groove in an exterior portion of said seat plug.

7. The pumping apparatus of claim 6, further comprising at least one opening in said groove in said exterior portion of said seat plug, and continuing through to said interior passage of said seat plug.

8. The pumping apparatus of claim 7 wherein said at least one opening in said groove in said exterior portion of said seat plug is directed away from a center of said interior passage of said seat plug.

9. The pumping apparatus of claim 1 further comprising a top plunger adapter interposed between said plunger adapter and said valve rod.

10. The pumping apparatus of claim 9 wherein said top plunger adapter comprises, in combination: an interiors passage terminating at a cap located within said top plunger adapter; a plurality of angled veins in an exterior portion of said top plunger adapter; and for each of said plurality of veins, an opening extending from said interior passage into said vein.

11. The pumping apparatus of claim 10 wherein said top plunger adapter further comprises a region of reduced outer diameter located north of said angled veins.

12. The pumping apparatus of claim 10 further comprising a laterally-extending notched area along a north side portion of each of said veins, so that a width of said veins is greater at a north end thereof than at a south end thereof.

13. The pumping apparatus of claim 1 further comprising a cage, through which said valve rod passes or is attached.

14. The pumping apparatus of claim 13, wherein said cage comprises a plurality of angled veins in an exterior portion thereof.

15. A pumping method comprising the steps of:

providing a pumping apparatus as claimed in claim 1 hereof;

utilizing said pumping apparatus, pumping fluid;

wherein a portion of said fluid enters an interior of said plunger adapter through said interior passage and wherein a portion of said fluid enters said interior of said plunger adapter through said at least one opening in said groove; and de-emulsifying said fluid and solid impurities entrained therein.

* * * * *